US008820747B2

(12) United States Patent
Zubia et al.

(10) Patent No.: US 8,820,747 B2
(45) Date of Patent: Sep. 2, 2014

(54) MULTIPLE SEALING ELEMENT ASSEMBLY

(75) Inventors: Alberto Zubia, Houston, TX (US); Trung Leduc, Houston, TX (US); Huward Paul Fontenot, Jr., Spring, TX (US); Robert James Costo, Jr., The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 378 days.

(21) Appl. No.: 12/860,320

(22) Filed: Aug. 20, 2010

(65) Prior Publication Data

US 2012/0043726 A1 Feb. 23, 2012

(51) Int. Cl.
*E21B 33/128* (2006.01)

(52) U.S. Cl.
USPC ..... 277/342; 277/322; 277/337; 277/336

(58) Field of Classification Search
CPC ... E21B 2033/005; E21B 33/04; E21B 33/08; E21B 33/12; E21B 33/1216; E21B 33/1208; E21B 33/122
USPC ..... 277/322, 328, 329, 336, 337, 342
See application file for complete search history.

(56) References Cited

U.S. PATENT DOCUMENTS

| | | | | |
|---|---|---|---|---|
| 3,387,851 | A | 6/1968 | Cugini | |
| 3,868,832 | A | 3/1975 | Biffle | |
| 4,200,297 | A * | 4/1980 | Tricon | 277/337 |
| 5,022,472 | A | 6/1991 | Bailey et al. | |
| 6,354,385 | B1 | 3/2002 | Ford et al. | |
| 7,802,635 | B2 * | 9/2010 | Leduc et al. | 175/48 |
| 7,950,474 | B2 * | 5/2011 | Leduc et al. | 175/48 |
| 2006/0108119 | A1 | 5/2006 | Bailey et al. | |
| 2009/0152006 | A1 * | 6/2009 | Leduc et al. | 175/48 |
| 2010/0175882 | A1 | 7/2010 | Bailey et al. | |
| 2010/0269570 | A1 * | 10/2010 | Leduc et al. | 73/40.5 R |

FOREIGN PATENT DOCUMENTS

| | | | |
|---|---|---|---|
| GB | 2443561 | A | 5/2008 |
| GB | 2456890 | A | 8/2009 |
| RU | 1776759 | A1 | 11/1992 |
| RU | 2170329 | C2 | 7/2001 |
| WO | 99/50524 | A2 | 10/1999 |
| WO | 2009/029147 | A1 | 3/2009 |

OTHER PUBLICATIONS

Search Report issued with Eurasian Application No. 201101103 dated Mar. 2, 2012, 4 pages.
Search Report issued in corresponding European Application No. 11178052.4; Dated Apr. 8, 2013 (6 pages).
Official Notification issued in corresponding Eurasian Application No. 201101103 with English communication reporting the same; Dated Jul. 22, 2013 (4 pages).
Official Notification issued in corresponding Eurasian Application No. 201101103/31 with English communication reporting the same; dated Feb. 24, 2014 (4 pages).

* cited by examiner

*Primary Examiner* — Gilbert Lee
(74) *Attorney, Agent, or Firm* — Osha Liang LLP

(57) ABSTRACT

A seal assembly, method for sealing a seal assembly and a modular seal unit for a rotating control device for use in an offshore environment. The modular seal unit includes a first outer housing, a first seal housing lockable within the first outer housing, and a first sealing element disposed on a lower end of the first seal housing. The first sealing element includes a throughbore configured to receive a drill pipe, and a sealing surface configured to seal against the drill pipe. The modular seal unit also includes a first connector configured to couple the first seal housing to the first outer housing, and a second connector configured to couple the first seal housing to one selected from a second outer housing of a second modular seal unit or a running tool adapter.

20 Claims, 5 Drawing Sheets

MULTIPLE SEALING ELEMENT ASSEMBLY

BACKGROUND OF INVENTION

1. Field of the Invention

The present disclosure generally relates to apparatus and methods for sealing in offshore wellbores. More particularly, the present disclosure relates to apparatus and methods to seal against a drill pipe in subsea wellbores offshore during drilling operations.

2. Background Art

Wellbores are drilled deep into the earth's crust to recover oil and gas deposits trapped in the formations below. Typically, these wellbores are drilled by an apparatus that rotates a drill bit at the end of a long string of threaded pipes known as a drillstring. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

As wellbores are drilled several thousand feet below the surface, the hydrostatic column of drilling mud serves to help prevent blowout of the wellbore as well. Often, hydrocarbons and other fluids trapped in subterranean formations exist under significant pressures. Absent any flow control schemes, fluids from such ruptured formations may blow out of the wellbore like a geyser and spew hydrocarbons and other undesirable fluids (e.g., $H_2S$ gas) into the atmosphere. As such, several thousand feet of hydraulic "head" from the column of drilling mud helps prevent the wellbore from blowing out under normal conditions.

However, under certain circumstances, the drill bit will encounter pockets of pressurized formations and will cause the wellbore to "kick" or experience a rapid increase in pressure. Because formation kicks are unpredictable and would otherwise result in disaster, flow control devices known as blowout preventers ("BOPs"), are mandatory on most wells drilled today. One type of BOP is an annular blowout preventer. Annular BOPs are configured to seal the annular space between the drillstring and the inside of the wellbore. Annular BOPs typically include a large flexible rubber packing unit of a substantially toroidal shape that is configured to seal around a variety of drillstring sizes when activated by a piston. Furthermore, when no drillstring is present, annular BOPs may even be capable of sealing an open bore. While annular BOPs are configured to allow a drillstring to be removed (i.e., tripped out) or inserted (i.e., tripped in) therethrough while actuated, they are not configured to be actuated during drilling operations (i.e., while the drillstring is rotating). Because of their configuration, rotating the drillstring through an activated annular blowout preventer would rapidly wear out the packing element.

As such, rotating control devices are frequently used in oilfield drilling operations where elevated annular pressures are present. A typical rotating control device (RCD) includes a packing element and a bearing package, whereby the bearing package allows the packing element to rotate along with the drillstring. Therefore, in using a RCD, there is no relative rotational movement between the packing element and the drillstring, only the bearing package exhibits relative rotational movement. Examples of RCDs include U.S. Pat. No. 5,022,472 issued to Bailey et al. on Jun. 11, 1991 (assigned to Drilex Systems), and U.S. Pat. No. 6,354,385 issued to Ford et al. on Mar. 12, 2002, assigned to the assignee of the present application, and both are hereby incorporated by reference herein in their entirety. In some instances, dual stripper rotating control devices having two sealing elements, one of which is a primary seal and the other a backup seal, may be used. As the assembly of the bearing package along with the sealing elements and the drillstring rotate, leaks may occur between the drillstring and the primary sealing element. An apparatus or method of detecting and isolating leaks between the drillstring and sealing element while drilling would be well received in the industry.

SUMMARY OF INVENTION

In one aspect, the embodiments disclosed herein relate to a modular seal unit for a rotating control device for use in an offshore environment, the modular seal unit including a first outer housing, a first seal housing lockable within the first outer housing, and a first sealing element disposed on a lower end of the first seal housing, the first sealing element including a throughbore configured to receive a drill pipe and a sealing surface configured to seal against the drill pipe. The modular seal unit also includes a first connector configured to couple the first seal housing to the first outer housing and a second connector configured to couple the first seal housing to one selected from a group including a second outer housing of a second modular seal unit and a running tool adapter.

In another aspect, embodiments disclosed herein relate to a seal assembly for a rotating control device including at least two modular seal units, wherein a top of a first modular seal unit is configured to connect to a bottom of a second modular seal unit. Each modular seal unit includes a first outer housing, a first seal housing lockable within the first outer housing, and a first sealing element disposed on a lower end of the first seal housing, the first sealing element including a throughbore configured to receive a drill pipe and a sealing surface configured to seal against the drill pipe. The modular seal unit further includes a first connector configured to couple the first seal housing to the first outer housing, and a second connector configured to couple the first seal housing to one selected from a group including a second outer housing of a second modular seal unit and a running tool adapter.

In yet another aspect, embodiments disclosed herein relate to a method of assembling a seal assembly, the method including providing a lower outer housing, installing the lower outer housing downhole, locking a first seal housing and a first sealing element within the lower outer housing, connecting a first modular seal unit to the first seal housing, and connecting the second modular seal unit to the first modular seal unit. The first modular seal unit includes a second outer housing, a second seal housing lockable within the second outer housing, a second sealing element disposed on a lower end of the second seal housing, a first connector configured to couple the second seal housing to the second outer housing, and a second connector configured to couple the second seal housing to one selected from a group including a second modular seal unit and a running tool adapter. The second sealing element includes a throughbore configured to receive a drill pipe, and a sealing surface configured to seal against the drill pipe.

Other aspects and advantages of the invention will be apparent from the following description and the appended claims.

DETAILED DESCRIPTION

In one aspect, embodiments disclosed herein relate to a modular seal unit, a seal assembly, and a method for assembling the seal assembly for use in a rotating control device in an offshore environment. More specifically, embodiments disclosed herein relate to a modular seal unit, a seal assembly, and a method for assembling the seal assembly that provide for additional sealing elements to be installed as needed in the offshore rotating control device.

Figure 1:
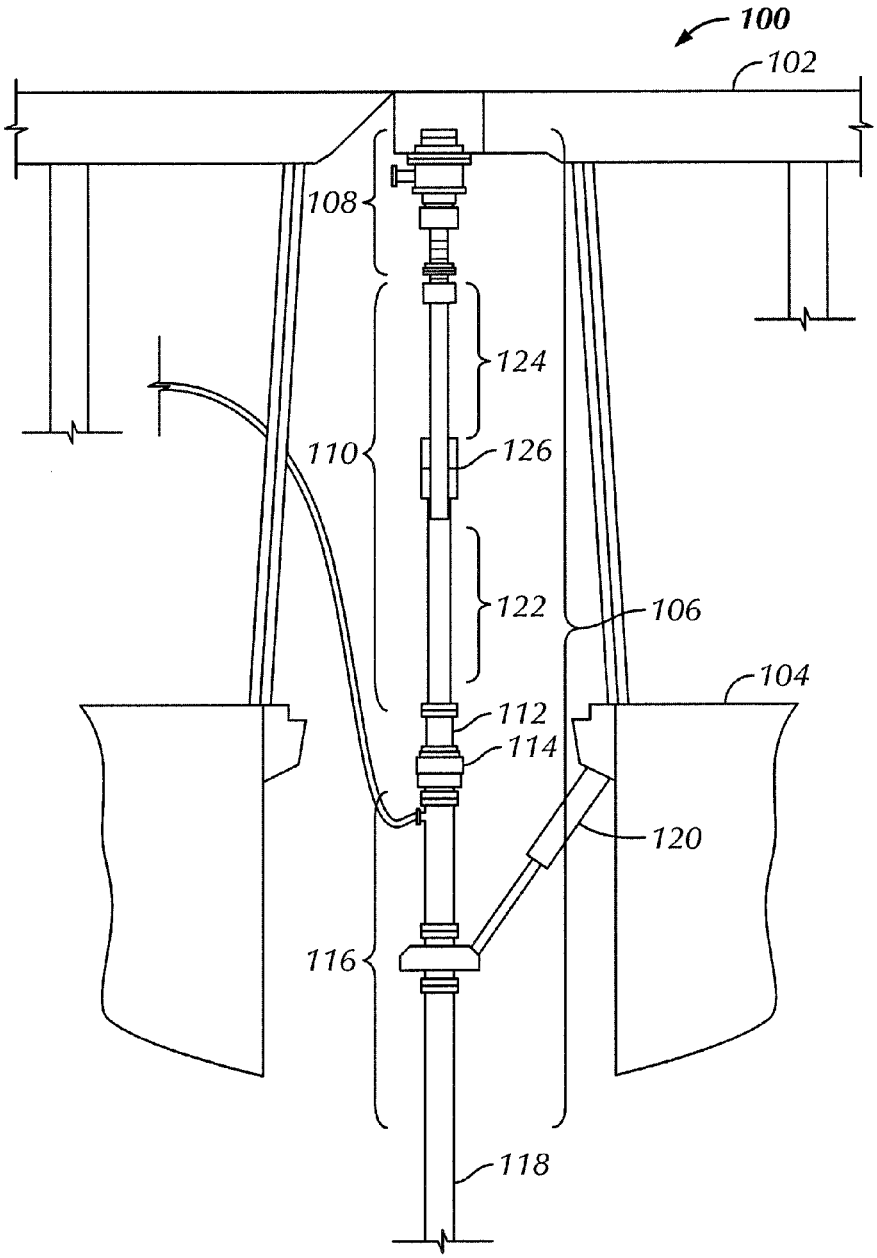
FIG. 1 shows an offshore drilling platform in accordance with embodiments disclosed herein.

Referring to FIG. 1, a portion of an offshore drilling platform 100 is shown. While offshore drilling platform 100 is depicted as a semi-submersible drilling platform, one of ordinary skill will appreciate that a platform of any type may be used including, but not limited to, drillships, spar platforms, tension leg platforms, and jack-up platforms. Offshore drilling platform 100 includes a rig floor 102 and a lower bay 104. A riser assembly 106 extends from a subsea wellhead (not shown) to offshore drilling platform 100 and includes various drilling and pressure control components.

From top to bottom, riser assembly 106 includes a diverter assembly 108 (shown including a standpipe and a bell nipple), a slip joint 110, a rotating control device 112, an annular blowout preventer 114, a riser hanger and swivel assembly 116, and a string of riser pipe 118 extending to subsea wellhead (not shown). While one configuration of riser assembly 106 is shown and described in FIG. 1, one of ordinary skill in the art should understand that various types and configurations of riser assembly 106 may be used in conjunction with embodiments of the present disclosure. Specifically, it should be understood that a particular configuration of riser assembly 106 used will depend on the configuration of the subsea wellhead below, the type of offshore drilling platform 100 used, and the location of the well site.

Because offshore drilling platform 100 is a semi-submersible platform, it is expected to have significant relative axial movement (i.e., heave) between its structure (e.g., rig floor 102 and/or lower bay 104) and the sea floor. Therefore, a heave compensation mechanism must be employed so that tension may be maintained in riser assembly 106 without breaking or overstressing sections of riser pipe 118. As such, slip joint 110 having a lower section 122, an upper section 124, and a seal housing 126, may be constructed to allow 30', 40', or more stroke (i.e., relative displacement) to compensate for wave action experienced by drilling platform 100. Furthermore, a hydraulic member 120 is shown connected between rig floor 102 and hanger and swivel assembly 116 to provide upward tensile force to string of riser pipe 118 as well as to limit a maximum stroke of slip joint 110. To counteract translational movement (in addition to heave) of drilling platform 100, an arrangement of mooring lines (not shown) may be used to retain drilling platform 100 in a substantially constant longitudinal and latitudinal area.

Figure 2:
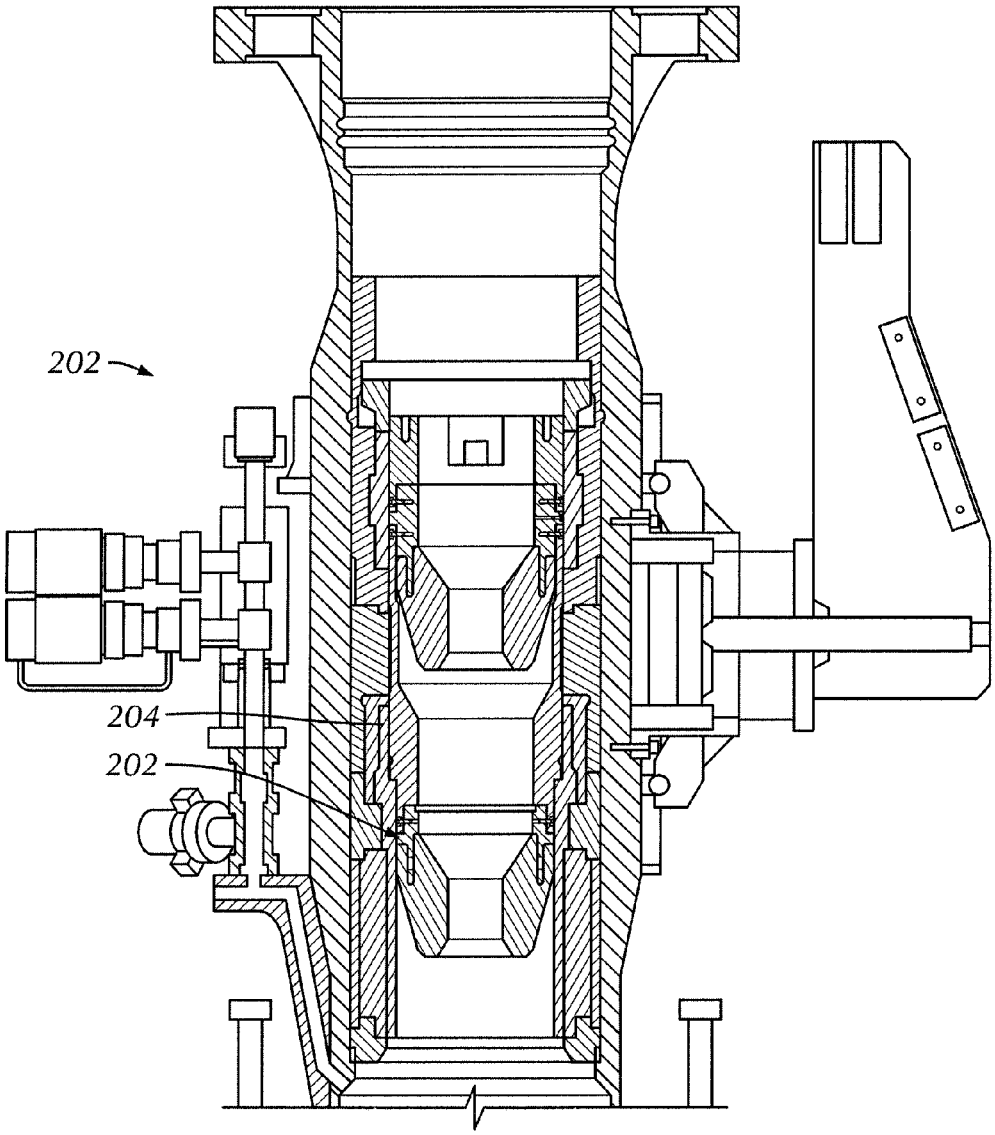
FIG. 2 shows a section view of a rotating control device in accordance with embodiments disclosed herein.

Looking to FIG. 2, a cross-sectional view of a rotating control device 202 in accordance with embodiments disclosed herein is shown. Rotating control device 202 may include a bearing package 204 and a seal assembly 206 configured to seal against a drillstring (not shown) while allowing rotation of the drill string.

Figure 3:
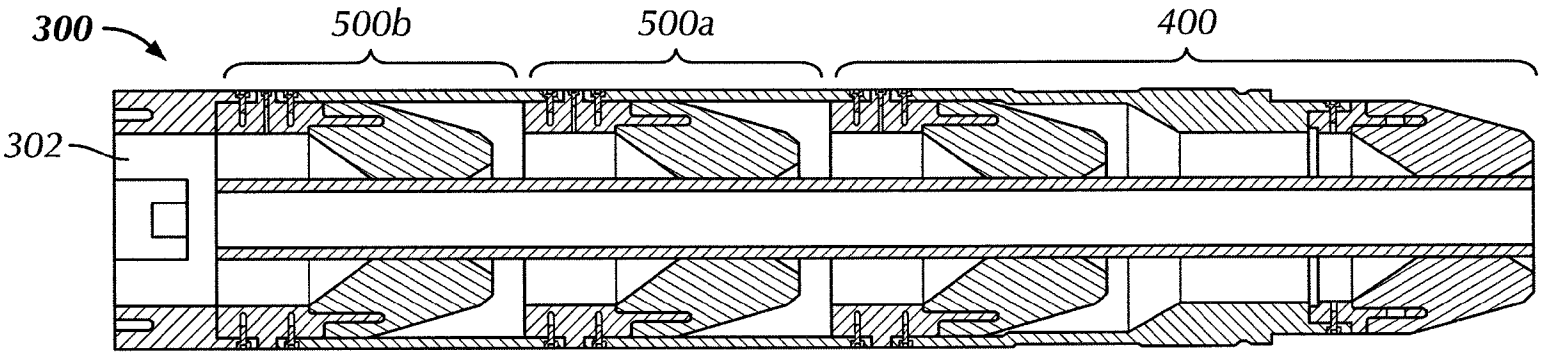
FIG. 3 shows a cross-section view of a modular seal unit in accordance with embodiments disclosed herein.

Referring now to FIG. 3, a cross-sectional view of a seal assembly 300 in accordance with embodiments disclosed herein is shown. Seal assembly 300 may include a lower portion 400 and at least one modular seal unit 500 connected to lower portion 400. In FIG. 3, two modular seal units **500*a*, 500*b* are shown coupled in series to lower portion 400. Coupled to upper modular seal unit 500*b* is a running tool adapter 302** which will be discussed in greater detail below.

Figure 4:
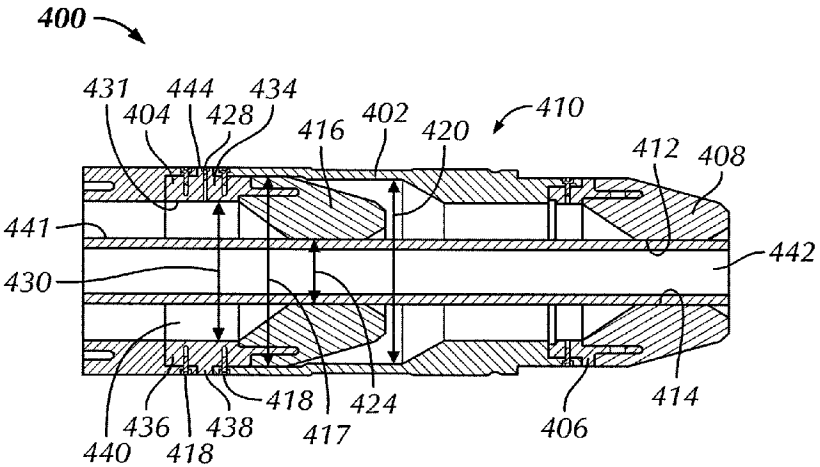
FIG. 4 shows a cross-section view of a seal assembly in accordance with embodiments disclosed herein.

Looking to FIG. 4, a detailed cross-section view of lower portion 400 of seal assembly 300 is shown having a drillstring 442 disposed therethrough. Lower portion 400 may include a lower sealing element 408 having a throughbore 412 and a first sealing surface 414. One having ordinary skill in the art will appreciate that lower sealing element 408 may be designed having a size, shape, and material configured to seal against a wide range of drillstring sizes. For example, a drillstring having a larger diameter than that of drillstring 442 may cause throughbore 412 to expand by stretching the material of lower sealing element 408. In certain embodiments, lower sealing element 408 may be formed from material such as, for example, an elastomer. Additionally, throughbore 412 may be designed to accommodate a drillstring 442 having an outer diameter between approximately 2⅜ inches and approximately 9½ inches.

Lower sealing element 408 may be coupled to a lower seal housing 406 using any known coupling means such as, for example, mechanical fasteners, adhesives, and welding. Alternatively, in certain embodiments, lower sealing element 408 may be molded onto lower seal housing 406. Lower seal housing 406 may be connected to lower outer housing 402 using any connecting means known in the art. In select embodiments, lower seal housing 406 may be coupled to lower outer housing 402 using a quick connect coupler such as, for example, a pin and latch connection or a fit and twist connection. Looking to lower outer housing 402, a locking profile 410 may be disposed on an outer surface thereof. Locking profile 410 may be configured to engage a corresponding profile (not shown) disposed on an inner surface of a separate downhole component. In certain embodiments, locking profile 410 disposed on lower outer housing 402 may be designed to engage a corresponding profile disposed on an inner surface of a bearing package 204 (shown in FIG. 2).

Still referring to FIG. 4, a second sealing element 416 may be connected to a second seal housing 404, and second seal housing 404 may be connected to lower outer housing 402 using connectors 418. Connectors 418 may include mechanical fasteners as shown; however, as discussed above, one having ordinary skill in the art will appreciate that any known connecting means may be used. Second sealing element 416 may be designed having a size, shape, and material configured to receive and seal against a drillstring 442 having a range of outer diameters. In certain embodiments, second sealing element 416 may be selected to seal against a drillstring 442 having an outer diameter between approximately 2⅜ inches and approximately 9½ inches. While lower sealing element 408 and second sealing element 416 are shown in FIG. 4 having a similar shape, one having ordinary skill in the art will appreciate that sealing elements of different shapes, sizes, and/or materials may be chosen for lower sealing element 408 and second sealing element 416.

Sealing element 416 may be sized having an outer diameter 417 substantially equal to a top inner diameter 420 of lower outer housing 402. Additionally, a lower portion 434 and an upper portion 436 of second seal housing 404 may have an outer diameter substantially equal to top inner diameter 420 of lower outer housing 402, as shown. Between lower portion 434 and upper portion 436, second seal housing 404 may include a shoulder 438. Shoulder 438 may contact a top end of lower outer housing 402 acting as a stop to prevent second seal housing 404 from sliding axially downward with respect to lower outer housing 402.

Second seal housing 404 may further include an inner diameter 430 which may be larger than small inner diameter portion 424 of second sealing element 416 such that when drillstring 442 is disposed through lower portion 400 of seal assembly 300, a chamber 440 may be formed between an outer surface 441 of drillstring 442 and inner surface 431 of second seal housing 404. In certain embodiments, second seal housing 404 may include a port 428 extending between an outermost surface 444 of second seal housing 404 and an inner surface 431 of second seal housing 404 and may be configured to provide a flow of fluid to and from chamber 440. Port 428 may be equipped with a pressure sensor (not shown) for determining a pressure within chamber 440. Those having ordinary skill in the art will appreciate that the pressure sensor (not shown) may further include equipment for storing or transmitting collected data.

Figure 5:
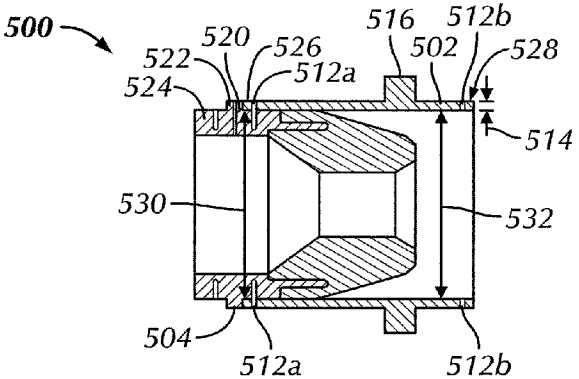
FIG. 5 shows a cross-section view of a seal assembly in accordance with embodiments disclosed herein.

Referring to FIG. 5, a cross-section view of modular seal unit 500 in accordance with embodiments disclosed herein is shown. Modular seal unit 500 may include an outer housing 502 and a support ring 516 disposed around outer housing 502. In certain embodiments, support ring 516 may be integrally formed with outer housing 502 or, alternatively, support ring 516 and outer housing 502 may be separate components later assembled using, for example, mechanical fasteners, adhesives, and/or welding. Support ring 516 may provide structural support to seal assembly 300 (shown in FIG. 3) to prevent excessive bending and/or buckling of the seal assembly. A thickness 514 of outer housing 502 may also be selected to provide support against possible bending and/or buckling of an assembled seal assembly. One having ordinary skill in the art will appreciate that an increased thickness may increase bending strength of the seal assembly. Outer housing 502 may further include connection means 512*a*, 512*b* disposed on an upper portion 526 and a lower portion 528, respectively, of outer housing 502, configured to connect with connection means 512*a*, 512*b* of additional modular seal units, as will be described in greater detail below. In certain embodiments, connection means 512*a*, 512*b* may include any known coupling means such as, for example, mechanical fasteners like bolts, pins, screws, threaded connections, etc.

Still referring to FIG. 5, modular seal unit 500 may further include a seal housing 504 disposed at an upper end 526 of outer housing 502. As discussed above, seal housing 504 may include a lower portion 520 having a first outer diameter 530 slightly less or substantially equal to an inner diameter 532 of outer housing 502, and designed to fit within outer housing 502. A shoulder 522 disposed on seal housing 504 may prevent seal housing 504 from sliding axially downward with respect to outer housing 502. Additionally, shoulder 522 may align seal housing 504 with outer housing 502 such that seal housing 504 and outer housing 502 may be connected using connection means 512*a* as shown. In certain embodiments, a quick connect mechanism may be used such as, for example, a pin and latch connector or a fit and twist connector; however, other connection means may also be used. An upper portion 524 of seal housing 504 may have an outer diameter substantially equal to outer diameter 530 of lower portion 520 of seal housing 504 so as to allow stacking of multiple modular seal units 500 in series by connecting a lower end of a second outer housing to an upper end of a first seal housing.

Figure 6:
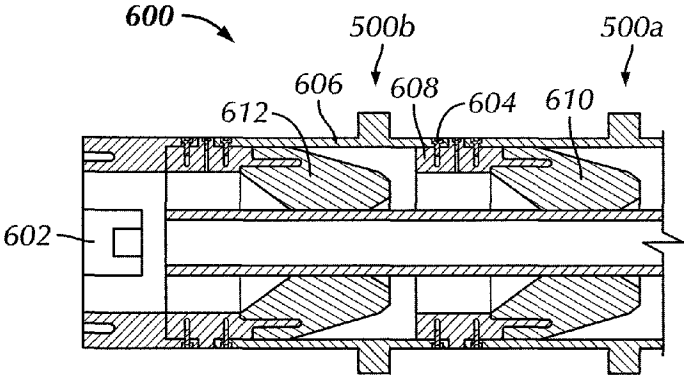
FIG. 6 shows a detailed cross-section view of a seal assembly in accordance with embodiments disclosed herein.

Looking to FIG. 6, a series 600 of first and second modular seal units 500*a*, 500*b*, respectively, is shown coupled to a running tool adapter 602. Series 600 of modular seal units may be connected to running tool adapter 602 using, for example, a slot and pin connection, so that the series 600 may be disconnected from running tool adapter 602 after installation is complete. In certain embodiments, the slot may be a j-slot.

First and second modular seal units 500*a*, 500*b* may be connected to each other prior to installation in a rotating control device as shown, or alternatively, may be installed in the rotating control device one at a time. Second modular seal unit 500*b* is shown connected to first modular seal unit 500*a* using a mechanical fastener 604 to couple outer housing 606 of second modular seal unit 500*b* to seal housing 608 of first modular seal unit 500*a*. As discussed above, any coupling means may be used to connect first and second modular seal units 500*a*, 500*b* including, for example, quick connectors such as pin and latch connectors and fit and twist connectors.

As shown in FIG. 6, sealing elements 610, 612 of first and second modular seal units 500*a*, 500*b*, respectively, may be of similar size and shape. However, as discussed above, each sealing element 610, 612 may be independently chosen to have any desirable size, shape, and/or material. In certain embodiments, it may be advantageous to use a single type of sealing element throughout a sealing assembly while in other embodiments, it may be desirable to include a variety of sealing elements having different sizes, shapes, and materials. In certain embodiments, each sealing element may be chosen based on factors such as, for example, drillstring size, formation pressure, desired sealing time, and type of drilling fluid. In select embodiments, sealing elements 610, 612 may be formed from a material such as, for example, nitrile, HNBR, urethane or butyl. Additionally, sealing elements 610, 612 may be selected to receive a drillstring 442 (FIG. 4) ranging in outer diameter from approximately 2⅜ inches to approximately 9½ inches.

Referring back to FIG. 3, installation of seal assembly 300 may be completed in steps. Lower portion 400 may be locked within a rotating control device 202 (shown in FIG. 2) using locking profile 410 (shown in FIG. 4). In certain embodiments, lower portion 400 may be locked into a bearing package 204 (shown in FIG. 2) within a rotating control device 202 such that rotation of seal assembly 300 with respect to an outer casing (not shown) is allowed. First and second modular seal units 500*a*, 500*b* may be connected to lower portion 400 of seal assembly 300 using a running tool adapter 302. Lower portion 400 may be installed before the installation of first and second modular seal units 500*a*, 500*b*, or may be installed with one or more of first and second modular seal units 500*a*, 500*b* connected thereto. Modular seal units may be connected in groups of two or more or, alternatively, modular seal units may be assembled one at a time. Any number of modular seal units may be stacked end to end to form a seal assembly. For example, between 2 and 15 modular seal units may be stacked to form a single seal assembly, although those skilled in the art will appreciate that more than 15 modular seal units may be used.

Figure 7:
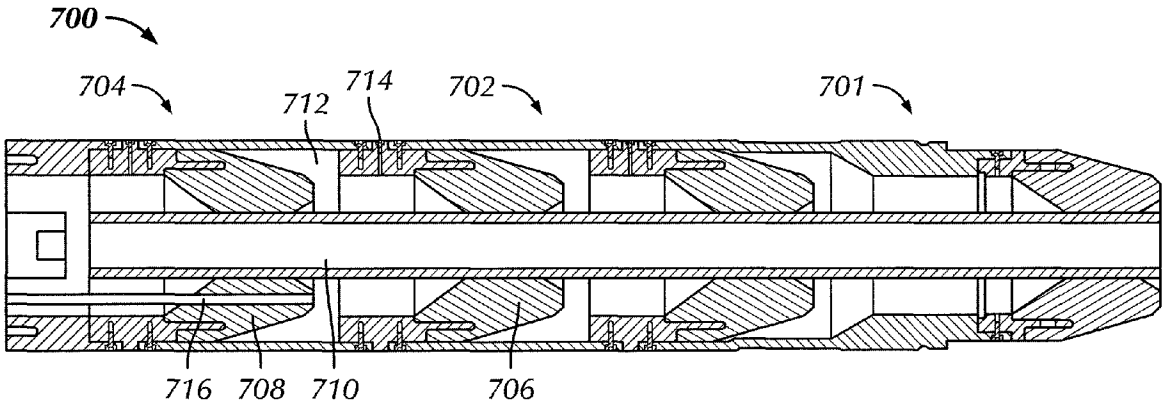
FIG. 7 shows a cross-section view of a seal assembly in accordance with embodiments disclosed herein.

Referring to FIG. 7, seal assembly 700 is shown having a first modular seal unit 702 and a second modular seal unit 704. First and second sealing elements 706, 708 of first and second modular seal units 702, 704, respectively, may sealingly contact drillstring 710 to create a chamber 712 therebetween. A port 714 may be fluidly connected to chamber 712 and may include equipment designed to measure a pressure within chamber 712. Pressure measurements may be either stored or relayed to a computer and/or an operator. By comparing a measured pressure within chamber 712 with a predicted pressure value, the predicted pressure value determined by measured wellbore surface pressure, a fluid leak caused by reduced sealability may be detected. For example, if the pressure within chamber 712 is less than the predicted pressure value, then fluid is determined to have leaked through first sealing element 706. Fluid leaks may also be detected by comparing physical measurements of wellbore pressure to applied calculated pressure between seals. Once a leak has been detected, it may be desirable to adjust the pressure of first and/or second sealing elements 706, 708, or to install a third modular seal unit (not shown) for redundancy. In certain embodiments, port 714 connected to hydraulic line 716 may be used to increase or decrease pressure within chamber 712, thereby adjusting the seal pressure of sealing elements 706, 708 against drillstring 710. Those of ordinary skill in the art will appreciate that the pressure within chamber 712 determined by hydraulic line 716 though port 714 may be controlled by an operator or by an automated system. In embodiments where an additional modular seal unit (not shown) is installed, the material, size, and/or shape of the sealing element selected may be determined by the type of mud used in the drilling system, the depth at which the sealing element will be set, and/or the amount of kick-back from the formation that the system is expected to withstand during the drilling operation.

In certain embodiments, pressure between each pair of seals may be distributed either evenly or unevenly. For example, if wellbore pressure is approximately 1000 psi and 6 seals are installed, the pressure between the two bottom seals may be approximately 800 psi, pressure between the next two sets of seals may be approximately 600 psi, and pressure between the top two sets of seals may be approximately 400 psi. In certain embodiments, varying the amount of pressure between certain sets of seals may balance the seals and may increase the life of the seals.

Advantageously, embodiments disclosed herein provide for a seal assembly that may be configured to include as many sealing elements as desired. For example, in certain embodiments, between 3 and 20 modular seal units may be assembled to make up a single seal assembly. In certain embodiments, the seal assembly may initially be equipped with two modular seal units and may be modified over time to include more than 20 modular seal units, as desired. Each modular seal unit included in the seal assembly may also be designed to resist bending such that a seal assembly having multiple modular seal units is supported against bending. Embodiments disclosed herein may allow for longer periods of sustained drilling without changing sealing elements. Additionally, rotational torque may be transferred through an increased sealing surface area and may providing a reduction in slippage of the drillstring with respect to the sealing elements and may also extend sealing element life. Each modular seal unit may be customized by using different sealing element materials, thereby allowing for different sealing element properties such as, for example, wear properties, chemical compatibility, pressure retention, etc. A pin and slot connector may allow for each component of the seal assembly to be installed or retrieved using a standard running tool.

Additionally, because each modular seal unit may include pressure measurement equipment, pressure data may be collected from multiple points within the seal assembly. The ability to collect pressure data from multiple points may advantageously provide for determining effectiveness of each modular seal unit and for detecting fluid leaks at various points within the seal assembly. Moreover, a hydraulic line may provide increased control over fluid pressure at multiple points within the seal assembly.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A seal unit comprising:
- a first outer housing;
- a first seal housing lockable within the first outer housing;
- a first sealing element disposed on a lower end of the first seal housing, the first sealing element including:
  - a throughbore configured to receive a drill pipe; and
  - a sealing surface configured to seal against the drill pipe;
- a first connector configured to couple the first seal housing to the first outer housing; and
- a second connector axially separated from the first connector, the second connector configured to directly couple the first seal housing to one selected from a group consisting of a second outer housing of a second modular seal unit and a running tool adapter,
- wherein the first connector and the second connector extend in a radial direction through the first seal housing.

2. The seal unit of claim 1, wherein at least one of the first connector and the second connector is a quick connect coupler.

3. The seal unit of claim 2, wherein the quick connect coupler is selected from a group consisting of a pin and latch connection and a fit and twist connection.

4. The seal unit of claim 1, wherein the first outer housing is configured to lock within a bearing package.

5. The seal unit of claim 1, further comprising a support ring disposed around an outer surface of the first outer housing.

6. A seal assembly for a rotating control device comprising:
- at least two modular seal units, each modular seal unit including:
  - a first outer housing;
  - a first seal housing lockable within the first outer housing;
  - a first sealing element disposed on a lower end of the first seal housing, the first sealing element including:
    - a throughbore configured to receive a drill pipe; and
    - a sealing surface configured to seal against the drill pipe;
  - a first connector configured to couple the first seal housing to the first outer housing; and
  - a second connector axially separated from the first connector, the second connector configured to directly couple the first seal housing to one selected from a group consisting of a second outer housing of a second modular seal unit and a running tool adapter,
  - wherein the first connector and the second connector extend in a radial direction through the first seal housing,
- wherein a top of a first modular seal unit is configured to connect to a bottom of the second modular seal unit.

7. The seal assembly of claim 6, further comprising at least one pressure chamber disposed between the at least two modular seal units.

8. The seal assembly of claim 6, wherein the first sealing element disposed in the first modular seal unit differs from a second sealing element disposed in the second modular seal unit.

9. The seal assembly of claim 8, wherein the first sealing element differs from the second sealing element in at least one selected from a group consisting of size, shape, and material.

10. The seal assembly of claim 6, further comprising a hydraulic line to provide fluid communication between a surface of a riser assembly and a pressure chamber of at least one modular seal unit.

11. The seal assembly of claim 6, further comprising between 3 and 15 modular seal units.

12. The seal assembly of claim 6, wherein the top of the first modular seal unit is configured to connect to the bottom of the second modular seal unit using a pin and latch connection.

13. The seal assembly of claim 6, wherein the top of the first modular seal unit is configured to connect to the bottom of the second modular seal unit using a fit and twist connection.

14. The seal assembly of claim 6, wherein at least one modular seal unit is coupled to a bearing package.

15. A method of assembling a seal assembly, the method comprising:

providing a lower outer housing;

installing the lower outer housing downhole;

locking a first seal housing and a first sealing element within the lower outer housing;

connecting a first modular seal unit to the first seal housing, the first modular seal unit including:

a second outer housing;

a second seal housing lockable within the second outer housing;

a second sealing element disposed on a lower end of the second seal housing, the second sealing element including:

a throughbore configured to receive a drill pipe; and a sealing surface configured to seal against the drill pipe;

a first connector configured to couple the second seal housing to the second outer housing; and a second connector axially separated from the first connector, the second connector configured to directly couple the second seal housing to one selected from a group consisting of a second modular seal unit and a running tool adapter, wherein the first connector and the second connector extend in a radial direction through the second seal housing; and connecting the second modular seal unit to the first modular seal unit.

16. The method of claim 15, wherein connecting the seal housing to the lower outer housing comprises engaging at least one connection selected from a group consisting of a pin and latch connection and a fit and twist connection.

17. The method of claim 15, wherein at least two modular seal units are connected in series to the first modular seal unit.

18. The method of claim 15, wherein between 3 and 15 modular seal units are connected in series to the first modular seal unit.

19. The method of claim 15, wherein modular seal units are connected using a running tool adapter.

20. The method of claim 15, further comprising determining pressure between at least two modular seal units and controlling pressure between at least two modular seal units using a hydraulic line.

* * * * *